US007063628B2

(12) United States Patent
Reyes et al.

(10) Patent No.: US 7,063,628 B2
(45) Date of Patent: Jun. 20, 2006

(54) PLATED MAGNESIUM GOLF CLUB HEAD

(75) Inventors: Herbert Reyes, Laguna Niguel, CA (US); Wayne H. Byrne, Murrieta, CA (US)

(73) Assignee: Callaway Golf Company, Carlsbad, CA (US)

( * ) Notice: Subject to any disclaimer, the term of this patent is extended or adjusted under 35 U.S.C. 154(b) by 248 days.

(21) Appl. No.: 10/708,744

(22) Filed: Mar. 23, 2004

(65) Prior Publication Data

US 2005/0215350 A1 Sep. 29, 2005

(51) Int. Cl.

| | |
|---|---|
| ***A63B 53/04*** | (2006.01) |
| *B05D 3/00* | (2006.01) |
| *B05D 7/00* | (2006.01) |
| *B05D 1/30* | (2006.01) |
| *B05D 1/00* | (2006.01) |
| *B05D 1/18* | (2006.01) |

(52) U.S. Cl. ..... 473/324; 473/345; 473/349

(58) Field of Classification Search ..... 473/324, 473/342, 345, 349, 409, 346, 329, 290–291
See application file for complete search history.

(56) References Cited

U.S. PATENT DOCUMENTS

| | | | | |
|---|---|---|---|---|
| 3,989,606 | A | 11/1976 | Kampert | |
| 4,196,061 | A | 4/1980 | Satee | |
| 5,131,986 | A | 7/1992 | Harada et al. | |
| 5,154,816 | A | 10/1992 | Martinou et al. | |
| 5,207,427 | A * | 5/1993 | Saeki | 473/343 |
| 5,403,460 | A | 4/1995 | Sala et al. | |
| 5,531,444 | A | 7/1996 | Buettner | |
| 5,578,187 | A | 11/1996 | Zitko et al. | |
| 5,603,667 | A | 2/1997 | Ezaki et al. | |
| 5,643,343 | A | 7/1997 | Selifanov et al. | |
| 5,792,004 | A | 8/1998 | Nagamoto | |
| 5,851,158 | A | 12/1998 | Winrow et al. | |
| 6,193,614 | B1 | 2/2001 | Sasamoto et al. | |
| 6,346,052 | B1 * | 2/2002 | Chappell | 473/324 |
| 6,602,149 | B1 * | 8/2003 | Jacobson | 473/329 |

* cited by examiner

*Primary Examiner*—Sebastiano Passaniti
(74) *Attorney, Agent, or Firm*—Michael A. Catania; Elaine H. Lo

(57) ABSTRACT

A golf club (40) having a club head (42) with a face component (60) and an aft-body (61) is disclosed herein. The face component (60) has a striking plate portion (72) and a return portion (74). The aft-body (61) is composed of a crown portion (62), a sole portion (64) and optionally a ribbon section (90). The face component (60) is composed of a metal material, and the aft-body (61) is composed of a metal material selected from the group consisting of magnesium alloys, aluminum alloys, magnesium and aluminum. A plating layer (300) is disposed on at least a portion of the aft-body (61). The plating layer (300) preferably comprises a nickel or nickel-based alloy material. The club head (42) preferably has a volume in the range of 290 cubic centimeters to 600 cubic centimeters.

13 Claims, 19 Drawing Sheets

PLATED MAGNESIUM GOLF CLUB HEAD

CROSS REFERENCE TO RELATED APPLICATIONS

Not Applicable

FEDERAL RESEARCH STATEMENT

Not Applicable

BACKGROUND OF INVENTION

1. Field of the Invention

The present invention relates to a golf club head with at least a portion of the golf club head composed of a plated magnesium material. More specifically, the present invention relates to a golf club head with a sole section composed of a nickel-plated magnesium material.

2. Description of the Related Art

Magnesium alloys typically have a density ranging from 1.7 grams per cubic centimeter ($g/cm^3$) to 1.9 $g/cm^3$. Golf club head components composed of magnesium alloys are formed through casting, metal injection molding and similar processes. However, magnesium alloys are relatively soft and easily scratched. Thus, golf club head components composed of magnesium alloys require protection from scratching and other durability problems.

Paints have so far proven ineffective in protecting golf club head components composed of magnesium alloys.

U.S. Pat. No. 5,538,246 to Dekura discloses a golf club head composed of an aluminum or magnesium alloy with a hosel attaching section.

U.S. Pat. No. 5,494,281 to Chen discloses a golf club head with a shock absorbing casing composed of a magnesium material and an elastic plate composed of an aluminum alloy.

U.S. Pat. No. 1,167,387 to Daniel discloses a hollow golf club head wherein the shell body is comprised of metal such as aluminum alloy and the face plate is comprised of a hard wood such as beech, persimmon or the like. The face plate is aligned such that the wood grain presents endwise at the striking plate.

U.S. Pat. No. 1,780,625 to Mattern discloses a club head with a rear portion composed of a light-weight metal such as magnesium. U.S. Pat. No. 1,638,916 to Butchart discloses a golf club with a balancing member composed of persimmon or a similar wood material, and a shell-like body composed of aluminum attached to the balancing member.

U.S. Pat. No. 5,603,667 to Ezaki et al., discloses an iron with a striking face composed of copper or a copper alloy and nickel-plated.

U.S. Pat. No. 5,207,427 to Saeki discloses an iron with a non-electrolytic nickel-boron plating and a chromate film, and a method for manufacturing such an iron.

U.S. Pat. No. 5,792,004 to Nagamoto discloses an iron composed of a soft-iron material with a carbonized surface layer.

U.S. Pat. No. 5,131,986 to Harada et al., discloses a method for manufacturing a golf club head by electrolytic deposition of metal alloys such as nickel-based alloys.

U.S. Pat. No. 6,193,614 to Sasamoto et al., discloses a golf club head with a face portion that is arranged to have its crystal grains of the material of the face portion oriented in a vertical direction. The '614 patent also discloses nickel-plating of the face portion.

U.S. Pat. No. 5,531,444 to Buettner discloses an iron composed of a ferrous material having a titanium nitride coating for wear resistance.

U.S. Pat. No. 5,851,158 to Winrow et al., discloses a golf club head with a coating formed by a high velocity thermal spray process.

Although the prior art has disclosed golf club head components composed of magnesium and magnesium alloys, the prior art has failed to disclose a plated magnesium alloy golf club head component.

SUMMARY OF INVENTION

One aspect of the present invention is a golf club head having a portion composed of a plated magnesium alloy. The plating has a thickness preferably ranging from 0.0002 inch to 0.002 inch. The plating is preferably a nickel plating or a nickel and chrome plating. The plating may be electroless or electrolytic. The plating preferably has a Rockwell C hardness of greater than 50.

Yet another aspect of the present invention is a golf club head including a face component composed of a metal material and an aft-body composed of a plated magnesium alloy. The face component has a striking plate portion and a return portion. The striking plate portion has a thickness in the range of 0.010 inch to 0.250 inch. The return portion has a thickness in the range of 0.010 inch to 0.200 inch. The aft-body has a crown portion, a sole portion and a ribbon portion. The aft-body is attached to the return portion of the face component. The golf club head has a coefficient of restitution of 0.81 to 0.94.

Yet another aspect of the present invention is a method for producing a nickel-plated magnesium component for a golf club head. The method includes de-ionizing a component for a golf club head, and electroless plating a nickel or nickel-based alloy material on the component to create a nickel-plated component having a plating layer with a thickness ranging from 0.0002 inch to 0.002 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
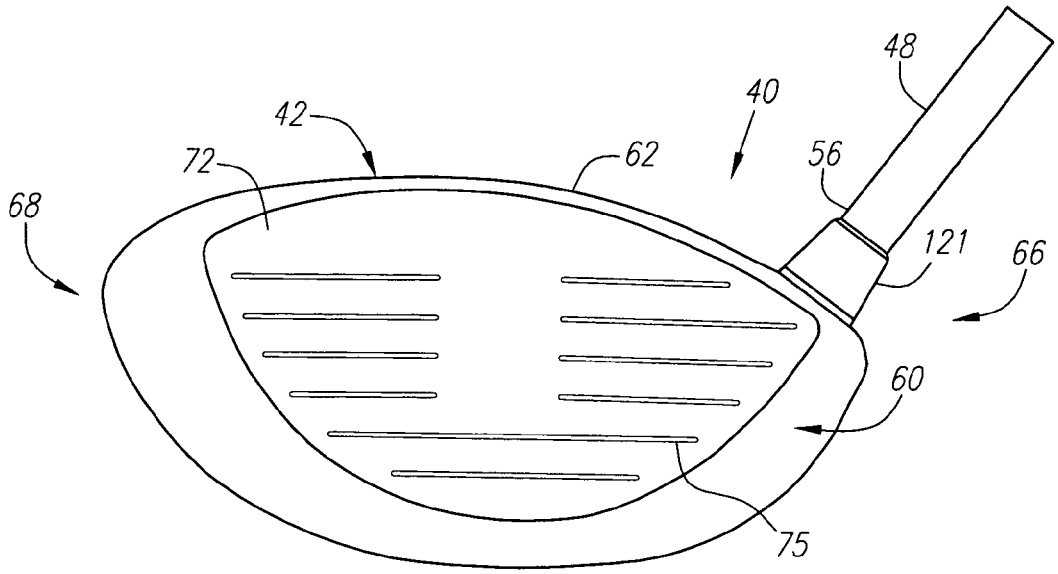
FIG. 1 is a front view of a golf club.

As shown in FIG. 1, a golf club is generally designated 40. The golf club 40 has a golf club head 42 and a shaft 48. The shaft 48 that has a butt end (not shown) with a grip (not shown) and a tip end 56 that is inserted into a hosel 54 of the club head 42.

As shown in FIGS. 1A–8, the club head 42 is generally composed of a face component 60 and an aft-body 61. The aft-body 61 is preferably composed of an upper section 200 and a lower section 202, which are joined together to form the aft-body 61. The aft-body 61 preferably has a crown portion 62 and a sole portion 64. The golf club head 42 has a heel end 66 nearest the shaft 48, a toe end 68 opposite the heel end 66, and a rear end 70 opposite the face component 60.

The face component 60 is generally composed of a single piece of metal, and is preferably composed of a forged metal material. More preferably, the forged metal material is a forged titanium material. Such titanium materials include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the face component 60 include stainless steel, other high strength steel alloy metals and amorphous metals. Alternatively, the face component 60 is manufactured through casting, forming, machining, powdered metal forming, metal-injection-molding, electro chemical milling, and the like.

FIGS. 20–24 illustrate the face component 60 in isolation. The face component 60 generally includes a striking plate portion (also referred to herein as a face plate) 72 and a return portion 74 extending laterally inward from the perimeter of the striking plate portion 72. The striking plate portion 72 typically has a plurality of scorelines 75 thereon.

In a preferred embodiment, the return portion 74 generally includes an upper lateral section 76, a lower lateral section 78, a heel lateral section 80 and a toe lateral section 82. Thus, the return 74 preferably encircles the striking plate portion 72 a full 360 degrees. However, those skilled in the pertinent art will recognize that the return portion 74 may only encompass a partial section of the striking plate portion 72, such as 270 degrees or 180 degrees, and may also be discontinuous.

The upper lateral section 76 extends inward, towards the aft-body 61, a predetermined distance, d, to engage the crown 62. In a preferred embodiment, the predetermined distance d ranges from 0.2 inch to 3.0 inches, more preferably 0.40 inch to 0.75 inch, and most preferably 0.68 inch, as measured from the perimeter 73 of the striking plate portion 72 to the rearward edge of the upper lateral section 76. In a preferred embodiment, the upper lateral section 76 has a general curvature from the heel end 66 to the toe section 68. The upper lateral section 76 has a length from the perimeter 73 of the striking plate portion 72 that is preferably a minimal length near the center of the striking plate portion 72, and increases toward the toe end 68 and the heel end 66.

The perimeter 73 of the striking plate portion 72 is defined as the transition point where the face component 60 transitions from a plane substantially parallel to the striking plate portion 72 to a plane substantially perpendicular to the striking plate portion 72. Alternatively, one method for determining the transition point is to take a plane parallel to the striking plate portion 72 and a plane perpendicular to the striking plate portion, and then take a plane at an angle of forty-five degrees to the parallel plane and the perpendicular plane. Where the forty-five degrees plane contacts the face component is the transition point thereby defining the perimeter of the striking plate portion 72.

The face component 60 preferably engages the crown portion 62 along a substantially horizontal plane. The crown 62 has a crown undercut portion 62*a*, which is placed under the return portion 74. Such an engagement enhances the flexibility of the striking plate portion 72 allowing for a greater coefficient of restitution. The crown portion 62 and the upper lateral section 76 are attached to each other as further explained below.

The heel lateral section 80 is substantially perpendicular to the striking plate portion 72, and the heel lateral section 80 covers the hosel 54 before engaging an optional ribbon section 90 and a bottom section 91 of the sole portion 64 of the aft-body 61. The heel lateral section 80 is attached to the sole 64, both the ribbon 90 and the bottom section 91, as explained in greater detail below. The heel lateral section 80 extends inward a distance, d'", from the perimeter 73 a distance of 0.2 inch to 3.0 inches, more preferably 0.50 inch to 1.5 inches, and most preferably 0.950 inch. The heel lateral section 80 preferably has a general curvature at its edge.

At the other end of the face component 60 is the toe lateral section 82. The toe lateral section 82 is attached to the sole 64, both the ribbon 90 and the bottom section 91, as explained in greater detail below. The toe lateral section 82 extends inward a distance, d", from the perimeter 73 a distance of 0.2 inch to 3.0 inches, more preferably 0.5 inch to 1.50 inches, and most preferably 1.20 inch. The toe lateral section 80 preferably has a general curvature at its edge.

The lower lateral section 78 extends inward, toward the aft-body 61, a distance, d', to engage the sole 64. In a preferred embodiment, the distance d' ranges from 0.2 inch to 3.0 inches, more preferably 0.50 inch to 1.50 inches, and most preferably 0.9 inch, as measured from the perimeter 73 of the striking plate portion 72 to the edge of the lower lateral section 78.

The sole portion 64 has a sole undercut 64*a* for placement under the return portion 74. The sole 64 and the lower lateral section 78, the heel lateral section 80 and the toe lateral section 82 are attached to each other as explained in greater detail below.

The aft-body 61 is preferably composed of an upper section 200 and a lower section 202, which are joined together to form the aft-body 61. The aft-body 61 is preferably composed of a low density metal material, preferably a magnesium alloy, aluminum alloy, magnesium or aluminum material. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). The aft-body 61 is preferably manufactured through metal-injection-molding. Alternatively, the aft-body 61 is manufactured through casting, die-casting, forming, machining, powdered metal forming, electro chemical milling, and the like.

A portion of the aft-body 61 or the entire aft-body is plated to provide greater durability than an un-plated equivalent. The plating layer 300 preferably ranges from 0.0002 inch to 0.002 inch, more preferably 0.001 inch. The plating material preferably has a Rockwell C hardness greater than 50. Preferably, the plating is a nickel plating. A preferred nickel plating is an amorphous nickel plating. An alternative nickel plating is a crystalline nickel plating.

A preferred plating process is electroless plating which involves plating onto a substrate by chemical reduction. Electroless platings are produced without an externally applied electric current. An alternative plating process is electrolytic plating, which is well-known and involves passing a direct current between an anode and a cathode to deposit metal or metal alloys particles, which are in an electrolyte medium, on the cathode.

The plating material is preferably nickel or a nickel-based alloy such as nickel boron, nickel-phosphorus (low (1–3% phosphorus), medium (5–9% phosphorus) and high (10–13% phosphorus)), nickel-boron-thallium, and like alloys. Such alloys are available from MacDermid Incorporated or ATO Tech Incorporated. Other plating materials include golf, rhodium, Black Nickel and silver.

In a preferred process, the golf club head components composed of the low density metal are degreased and cleaned through a de-ionized rinsing process. Next, a MAGENTA electroless nickel is applied to the component. Next, a medium phosphorus electroless nickel or a high phosphorus electroless nickel is applied over the MAGENTA electroless nickel. Finally, a layer of chrome or chromate is applied to the medium or high phosphorus electroless nickel.

In an alternative process, the golf club head components composed of the low-density metal are degreased and cleaned through a de-ionized rinsing process. Next, a flash coating of zinc is applied to the component. Then, a flash coating of copper is applied to the component over the zinc. Next, a nickel or nickel alloy is applied to the coating over the copper and zinc using either an electroless process or an electrolytic process. Finally, a chrome plating or a tin-cobalt plating can applied for a better appearance.

Figure 11:
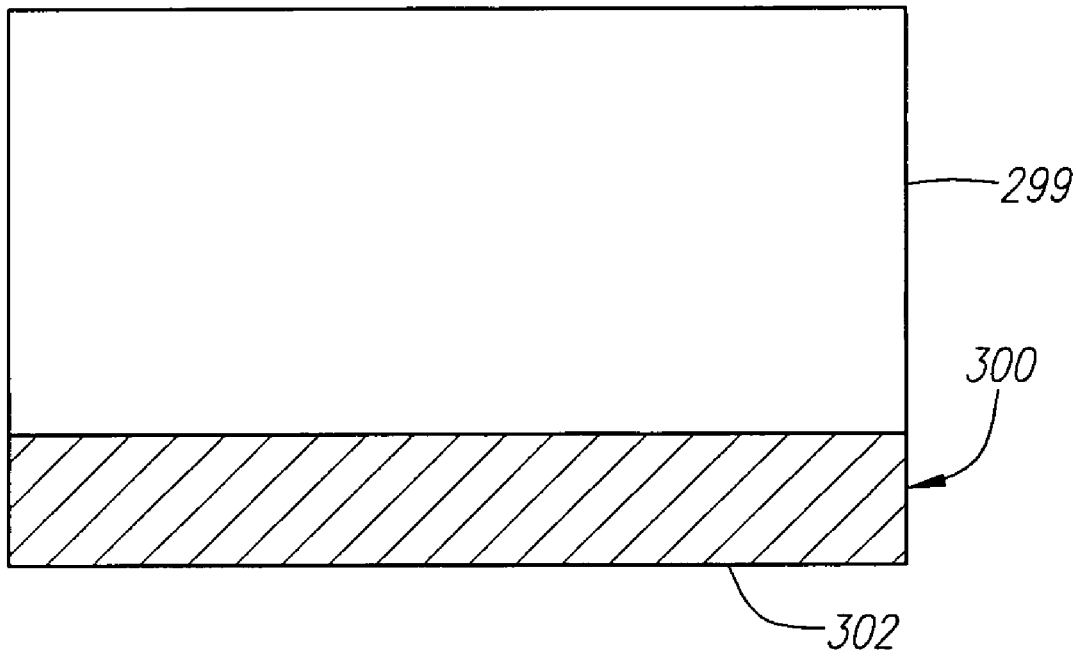
FIG. 11 is a cross-sectional view illustrating the plating.

As shown in FIG. 11, a plating layer 300 is positioned on a base layer 299, preferably a magnesium alloy material. In this embodiment, the plating layer 300 is only a nickel or nickel alloy plating layer 302.

Figure 12A:
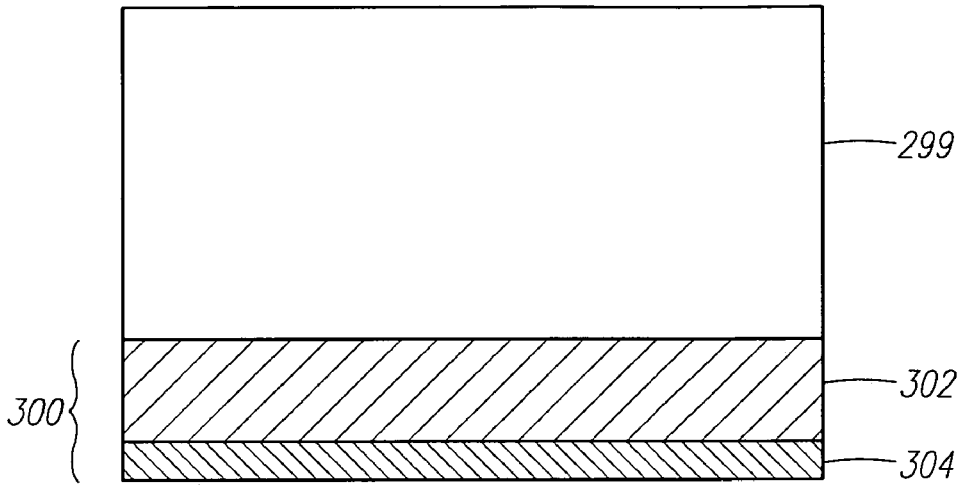
FIG. 12A is a cross-sectional view illustrating an alternative embodiment of the plating.
Figure 12B:
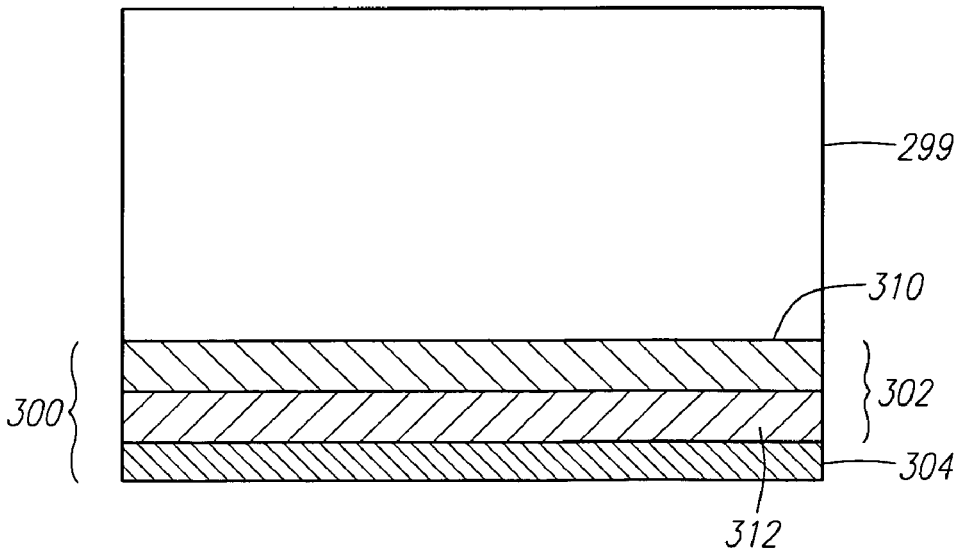
FIG. 12B is a cross-sectional view illustrating another alternative embodiment of the plating.

As shown in FIG. 12A, the plating layer 300 includes a nickel or nickel alloy plating layer 302 and a chromium, chromate or tin-cobalt top layer 304. As shown in FIG. 12B, the nickel or nickel alloy plating layer 302 is composed of a MAGENTA electroless nickel layer 310 and a medium or high phosphorus electroless nickel layer 312. The MAGENTA electroless nickel layer 310 is preferably approximately 0.0006 inch thick. The thickness of the medium or high phosphorus electroless nickel layer 312 is preferably between 0.0006 inch and 0.001 inch. The chromium, chromate or tin-cobalt top layer 304 is preferably 0.00001 inch to 0.00002 inch thick.

Figure 13:
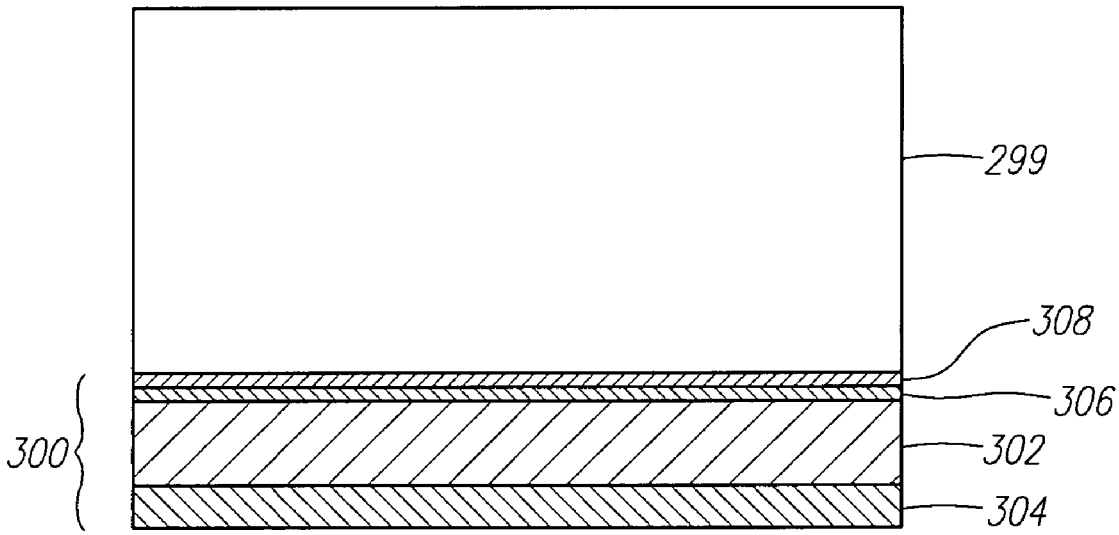
FIG. 13 is a cross-sectional view illustrating still another alternative embodiment of the plating.

As shown in FIG. 13, the plating layer 300 includes a zinc layer 308, a copper layer 306, a nickel or nickel alloy plating layer 302, and a chromium, chromate or tin-cobalt top layer 304.

In a preferred embodiment, the component to be nickel-plated is treated with ammonium fluoride to inhibit oxidation of the magnesium or magnesium alloy material.

In an alternative embodiment, a plasma vapor deposition coating or a chemical vapor deposition coating is applied over the plating 300 for greater durability or finishing. Titanium nitride or titanium aluminum carbide are preferred deposition coating materials.

The face component 60 is preferably adhered to the aft-body 61 with an adhesive, which is preferably placed on the interior surface of the return portion 74. The adhesive may also be placed on the undercut portions 62*a* and 64*a*. The upper section 200 is preferably adhered to the lower section 202 with an adhesive. Such adhesives include thermosetting adhesives in a liquid or a film medium. A preferred adhesive is a two-part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

Figure 25:
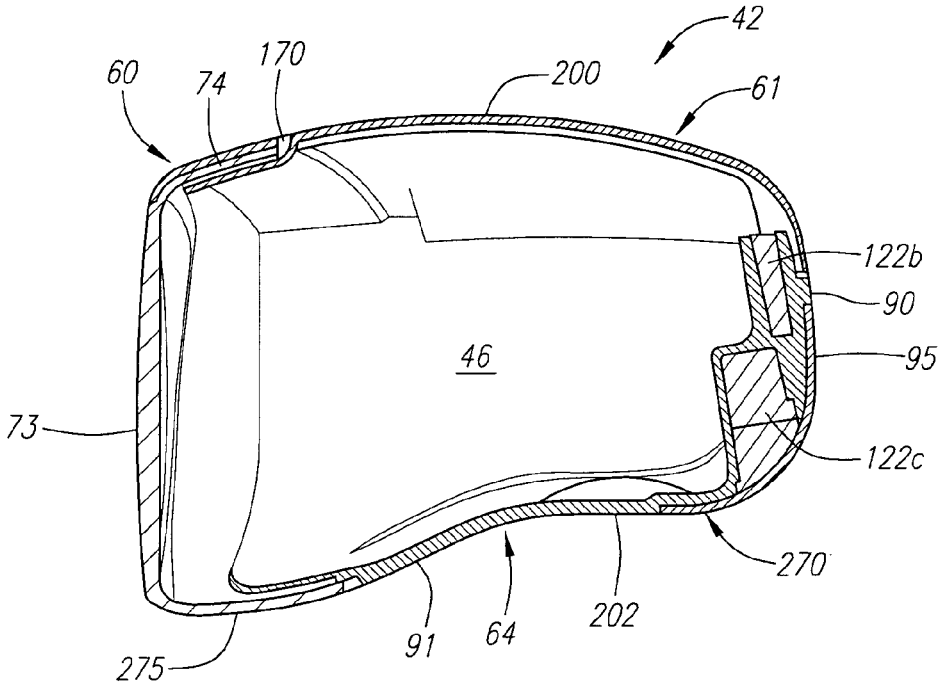
FIG. 25 is a cut-away view along line 25—25 of FIG. 7.
Figure 26:
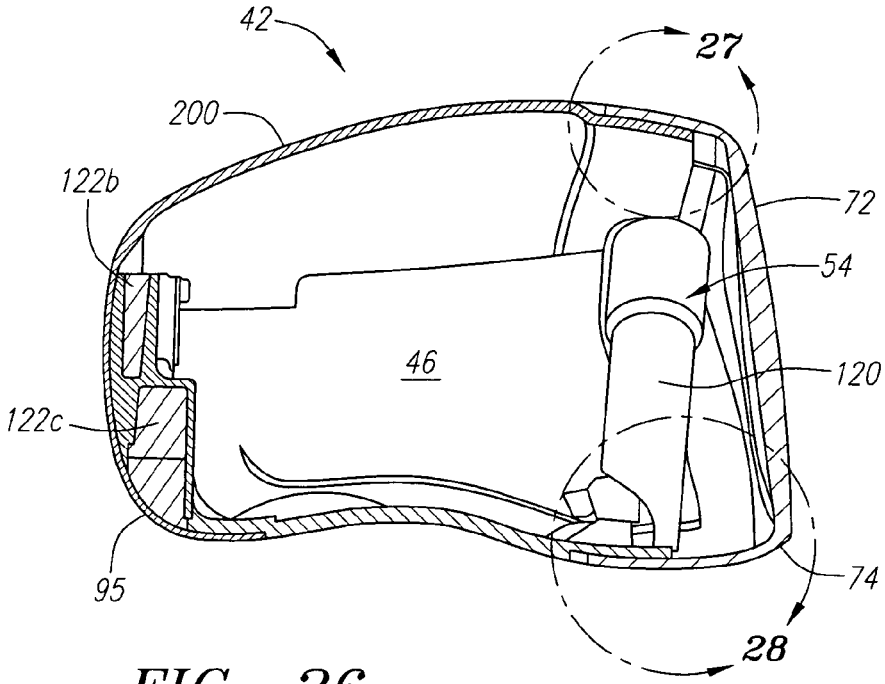
FIG. 26 is a cut-away view along line 26—26 of FIG. 7.
Figure 27:
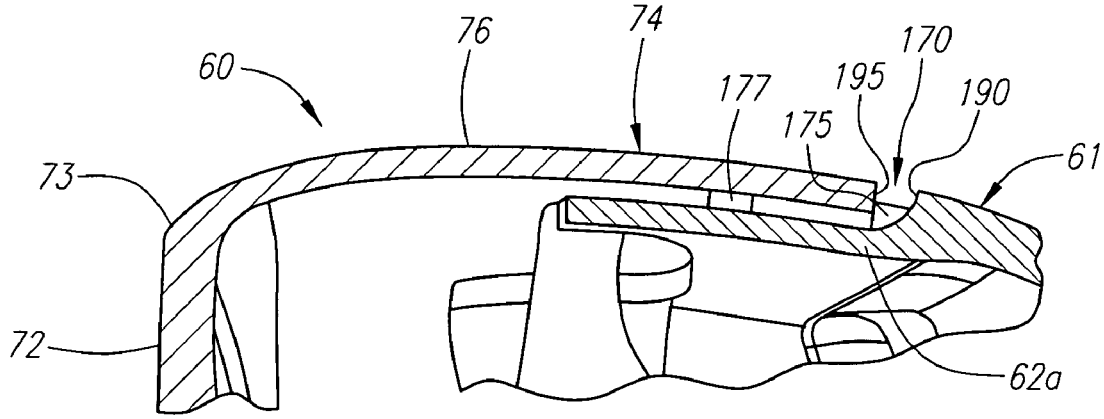
FIG. 27 is an enlarged view of circle 27 of FIG. 26.
Figure 28:
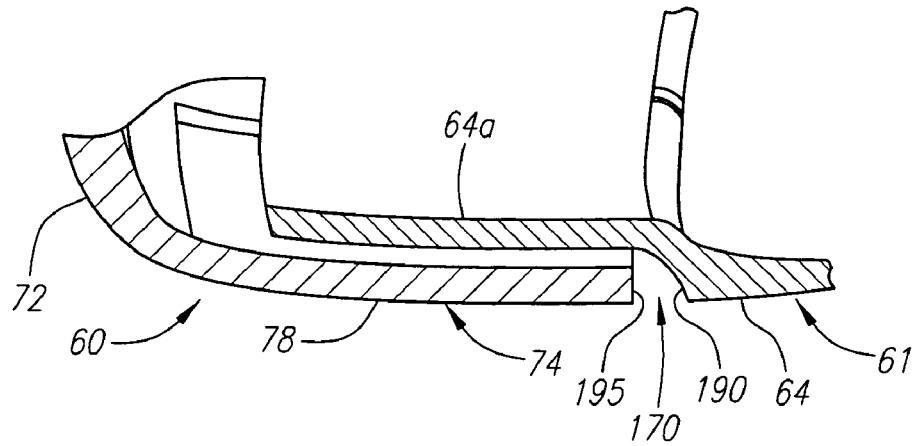
FIG. 28 is an enlarged view of circle 28 of FIG. 26.

As shown in FIGS. 25 and 26, the return portion 74 overlaps the undercut portions 62*a* and 64*a* by a distance preferably ranging from 0.25 inch to 1.00 inch, more preferably ranging from 0.40 inch to 0.70 inch, and most preferably 0.50 inch. In a preferred embodiment, an annular gap 170 is created between an edge 190 of the crown portion 62 and the sole portion 64, and an edge 195 of the return portion 74. The annular gap 170 preferably has a distance from the edge 190 of the crown portion 62 to the edge 195 of the return portion 74 ranging from 0.020 inch to 0.100 inch, more preferably from 0.050 inch to 0.070 inch, and is most preferably 0.060 inch. A plurality of projections 177 on an upper surface of the undercut portions 62*a* and 64*a* establishes a minimum bond thickness between the interior surface of the return portion 74 and the upper surface of the undercut portions 62*a* and 64*a*. The bond thickness preferably ranges from 0.002 inch to 0.100 inch, more preferably ranges from 0.005 inch to 0.040 inch, and is most preferably 0.030 inch. A liquid adhesive preferably secures the aft-body 61 to the face component 60. A leading edge of the undercut portions 62*a* and 64*a* may be sealed to prevent the liquid adhesive from entering the hollow interior 46.

Figure 15:
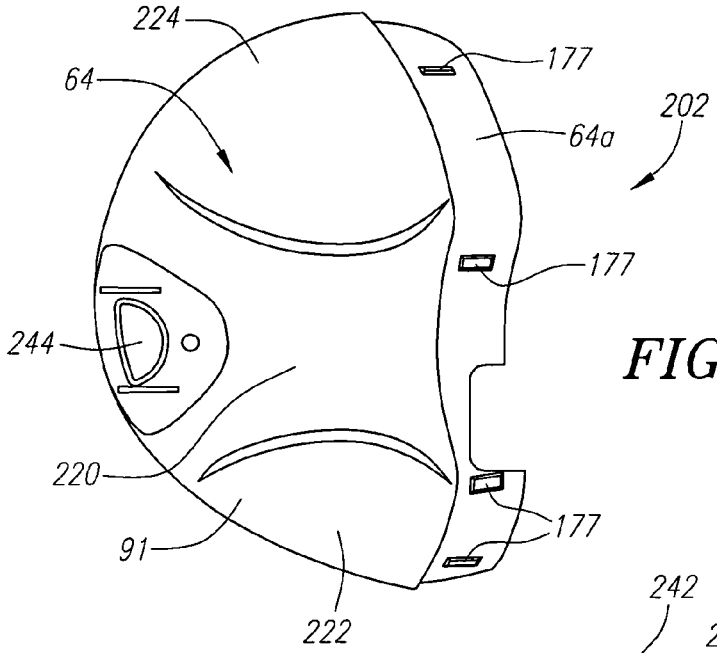
FIG. 15 is an isolated bottom view of a lower section of an aft-body of the golf club head.
Figure 16:
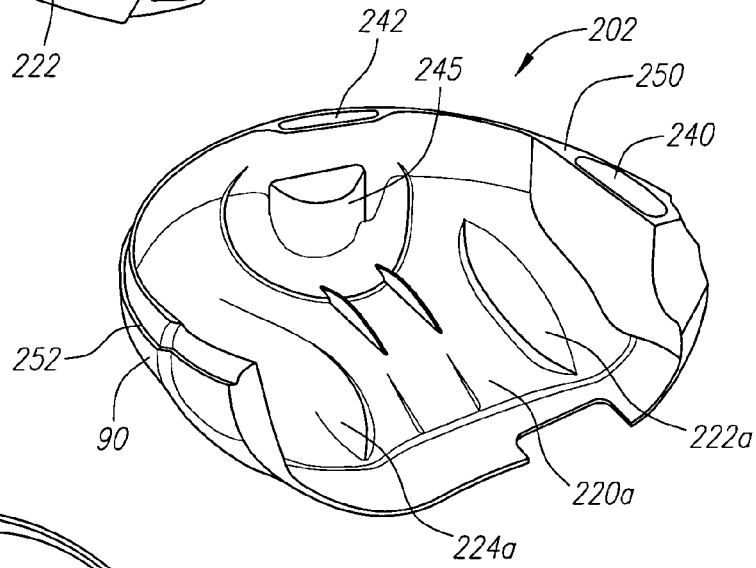
FIG. 16 is a top perspective view of the lower section of the aft-body of FIG. 15.
Figure 17:
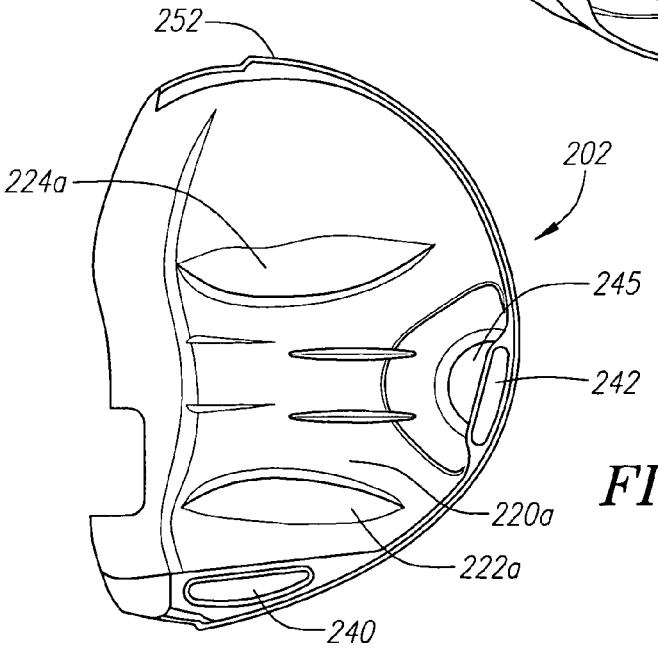
FIG. 17 is a top plan view of the lower section of the aft-body of FIG. 15.

FIGS. 15–17 illustrate a preferred embodiment of the lower section 202 of the aft-body 61. In a preferred embodiment, the entire lower section 202 of the aft-body 61 has a plating layer 300. The sole portion 64, including the bottom section 91 and the optional ribbon 90 which is substantially perpendicular to the bottom section 91, preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The undercut portion 64*a* has a similar thickness to the sole portion 64. The lower section 202 preferably comprises the bottom section 91 and a lower portion of the ribbon 90. The bottom section 91 preferably has a medial ridge 220 which extends from the undercut portion 64*a* rearward. A heel convex portion 222 is preferably located on a heel end 66 next to the medial ridge 220 and a toe convex portion 224 is preferably located on a toe end 68 next to the medial ridge 220. An alternative embodiment of the bottom section 91 is disclosed in U.S. Pat. No. 5,480,152, entitled Hollow, Metallic Golf Club Head With Relieved Sole And Dendritic Structures, assigned to Callaway Golf Company, and which pertinent parts are hereby incorporated by reference.

An aft weight cavity 244 is preferably located rearward of the medial ridge 220. The aft weight cavity 244 preferably allows swing weighting of the golf club head 42. The aft weight cavity 244 is accessible from the exterior of the golf club head 42 was all of the components are joined together. The interior of lower section 202 has a heel weight cavity 240 and a rear weight cavity 242 for placement of mass prior to the joining of components of the golf club head 42. The interior surface 220*a* of the medial ridge 220 creates a depression in the interior surface of the lower section 202 while the interior surfaces 222*a* and 224*a* of the heel convex portion 222 and toe convex portion 224 create projections in the interior surface of the lower section 202. A wall 245 of the aft weight cavity 244 projects inward from the interior surface of the lower section 202. The lower section 2020 has a first ledge 250 and a section ledge 252.

Figure 18:
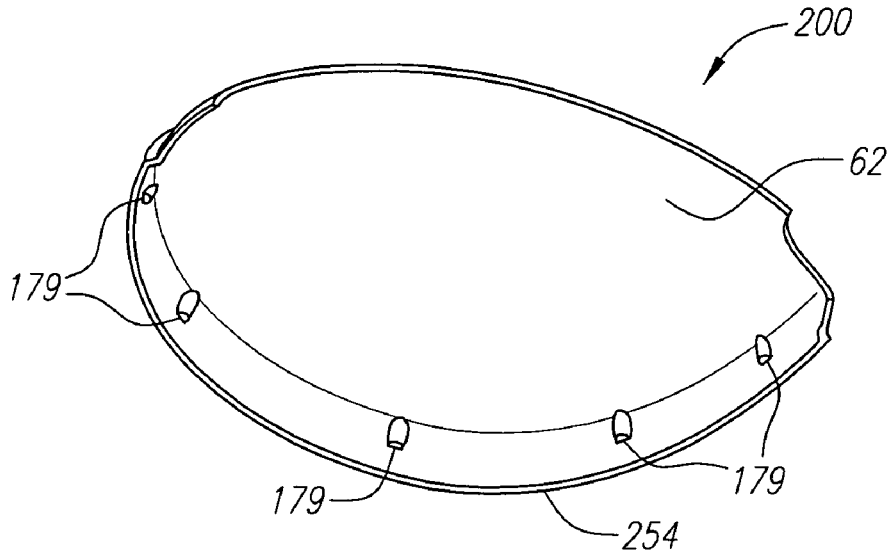
FIG. 18 is an isolated interior view of an upper section of an aft-body of the golf club head.
Figure 19:
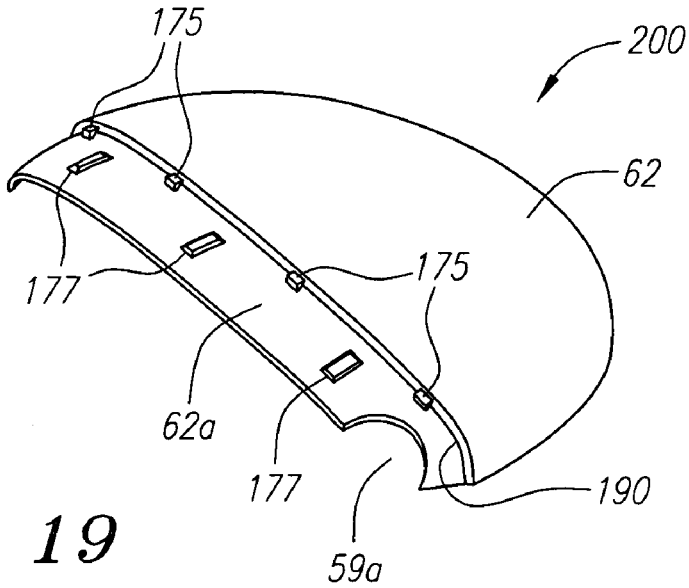
FIG. 19 is an isolated top perspective view of the upper section of the aft-body of FIG. 18.
Figure 20:
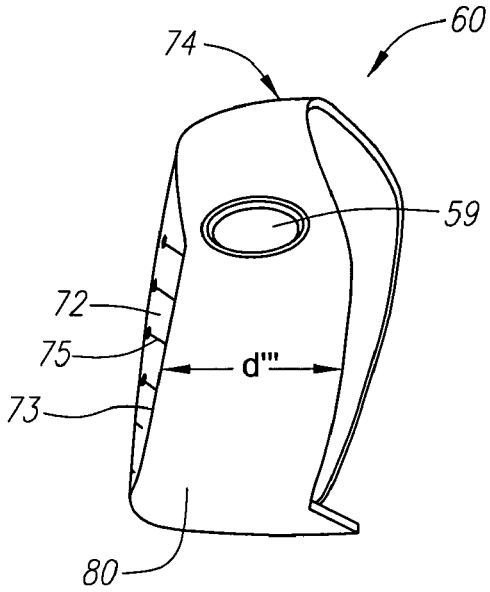
FIG. 20 is an isolated heel view of a face component of the golf club head.
Figure 21:
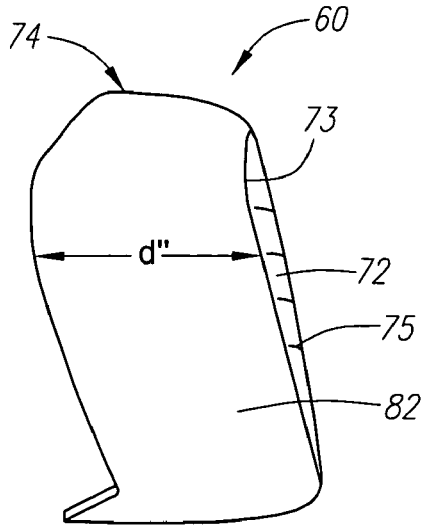
FIG. 21 is an isolated toe view of the face component of FIG. 20.
Figure 22:
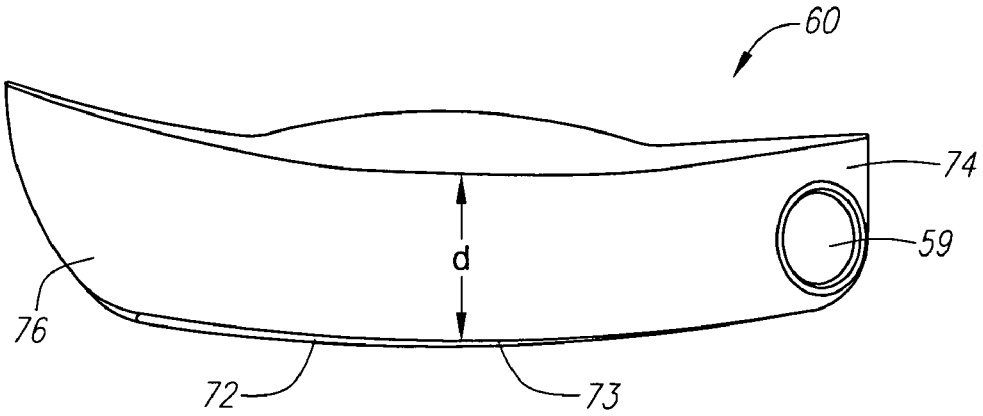
FIG. 22 is an isolated top plan view of the face component of FIG. 20.
Figure 23:
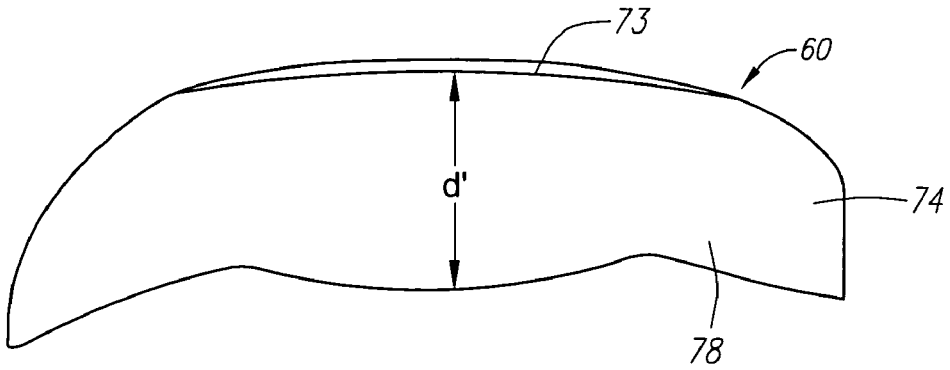
FIG. 23 is an isolated bottom plan view of the face component of FIG. 20.

FIGS. 18 and 19 illustrate the upper section 200 of the aft-body 61. The upper section 200 preferably comprises the crown portion 62 and an upper section of the ribbon 90. The crown portion 62 of the aft-body 61 is generally convex toward the sole 64, and engages the ribbon 90 of sole 64 outside of the engagement with the face member 60. The crown portion 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The undercut portion 62*a* has a similar thickness to the crown portion 62. The interior surface of the upper section 200 has a plurality of interior projections 179 the engage the first ledge 250 of the lower section 202. The upper section 200 has a first ledge 254 that engages the second ledge 252 of the lower section 202. As explained above, the upper section 200 and the lower section 202 are joined together preferably through use of an adhesive. An aft-body gap 205 is preferably created upon joining of the upper section 200 and the lower section 202. The crown undercut portion 62*a* has a plurality of undercut projections 177 extending upward from an exterior surface, and a plurality of gap projections 175 extending outward from the edge 190 of the crown portion 62. The plurality of gap projections 175 maintain the annular gap 170 between the crown portion 62 and the return portion 74.

FIGS. 25 and 26 illustrate the hollow interior 46 of the club head 42. The hosel 54 is disposed within the hollow interior 46, and is located as a part of the face component 60. The hosel 54 may be composed of a similar material to the face component 60, and is preferably secured to the face component 60 through welding or the like. The hosel 54 may also be formed with the formation of the face component 60. Additionally, the hosel may be composed of a non-similar material that is light weight and secured using bonding or other mechanical securing techniques. A hollow interior of the hosel 54 is defined by a hosel wall 120 that forms a tapering tube from the aperture 59 to the sole potion 64. The shaft 48 is disposed within a hosel insert 121 that is disposed within the hosel 54. Such a hosel insert 121 and hosel 54 are described in U.S. Pat. No. 6,352,482, entitled Golf Club With Hosel Liner, which pertinent parts are hereby incorporated by reference. Further, the hosel 54 is preferably located rearward from the striking plate portion 72 in order to allow for compliance of the striking plate portion 72 during impact with a golf ball. In one embodiment, the hosel 54 is disposed 0.125 inch rearward from the striking plate portion 72.

Figure 14:
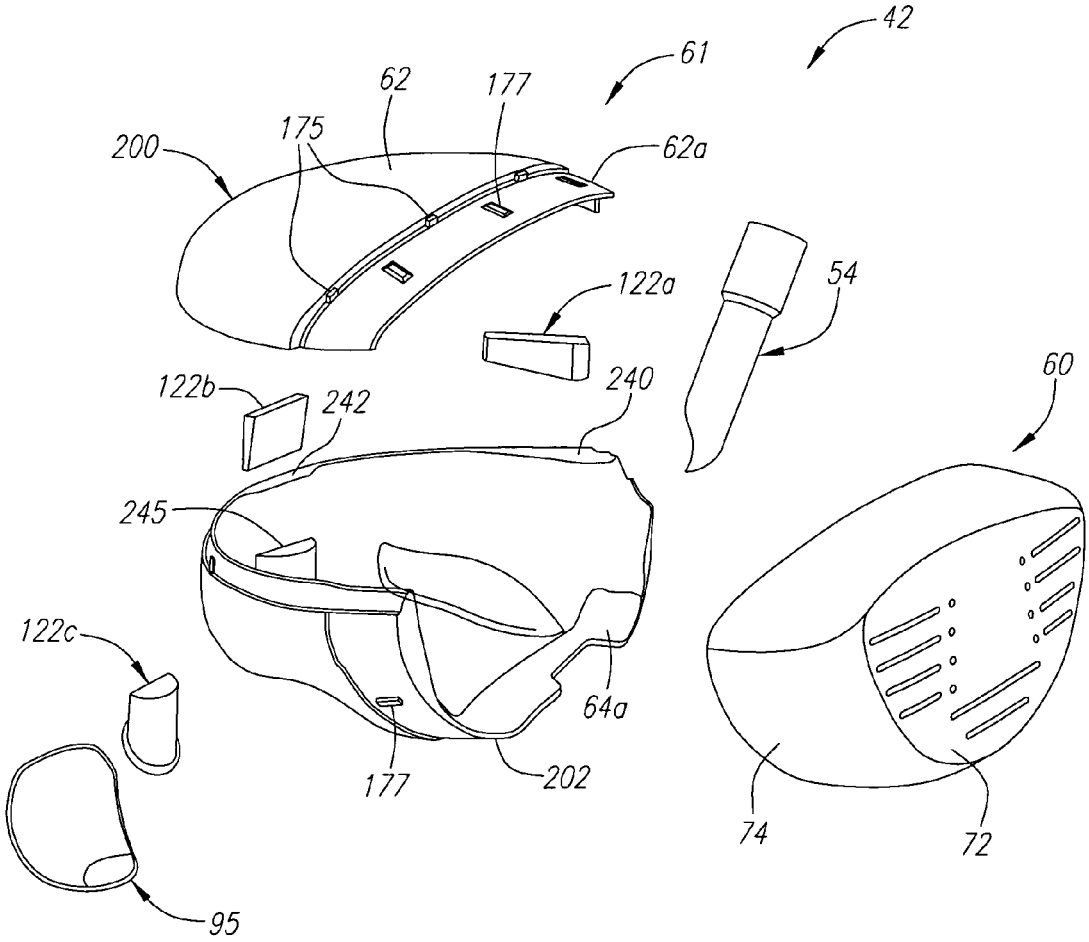
FIG. 14 is an exploded view of a golf club head.

As shown in FIG. 14, weighting members 122*a*, 122*b* and 122*c* are preferably disposed within the heel weight cavity 240, the rear weight cavity 242 and the aft weight cavity 244, respectively. In a preferred embodiment, all of the weighting members 122*a*, 122*b* and 122*c* are utilized in order to increase the moment of inertia and control the center of gravity of the golf club head 42. However, those skilled in the pertinent art will recognize that none or only one or two of the weighting members 122*a*, 122*b* and 122*c*, and also additional weighting members may be placed in locations of the club head 42 in order to influence the center of gravity, moment of inertia, or other inherent properties of the golf club head 42. A preferred use of weighting members to influence the center of gravity of the a golf club head is disclosed in co-pending U.S. patent application Ser. No. 10/249,510, filed on Apr. 15, 2003, for a Golf Club Head With Customizable Center Of Gravity, and assigned to Callaway Golf Company, which is hereby incorporated by reference in its entirety.

In a preferred embodiment, the weighting members 122*a*, 122*b* and 122*c* are bonded within the heel weight cavity 240, the rear weight cavity 242 and the aft weight cavity 244, respectively. Individually, each of the weighting members 122*a*, 122*b* and 122*c* has a mass ranging from 10 grams to 30 grams, preferably from 14 grams to 25 grams, and more preferably from 15 grams to 20 grams. Each of the weighting members 122*a*, 122*b* and 122*c* has a density ranging from 5 grams per cubic centimeters to 20 grams per cubic centimeters, more preferably from 7 grams per cubic centimeters to 12 grams per cubic centimeters, and most preferably 8.0 grams per cubic centimeters.

Figure 24:
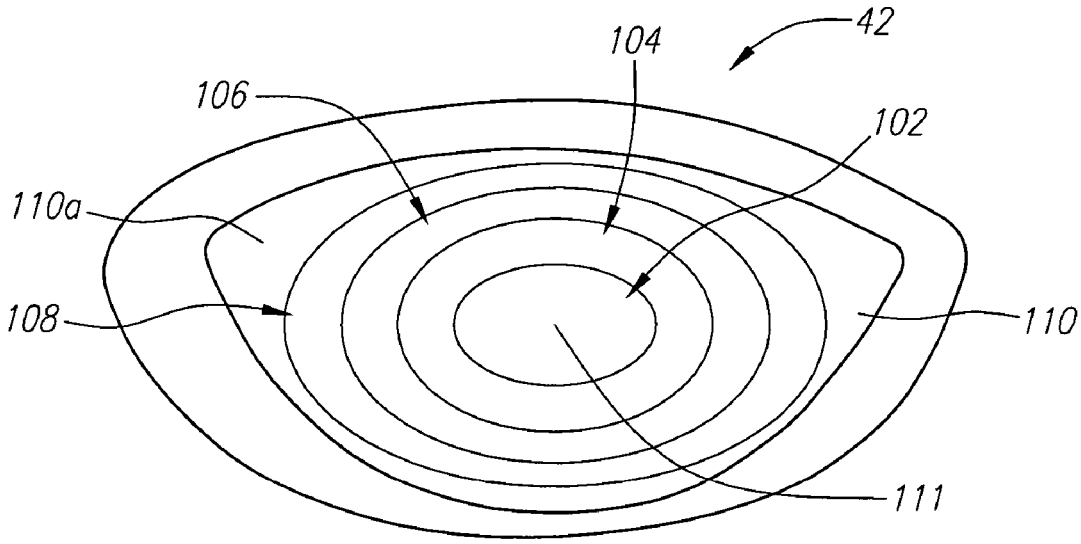
FIG. 24 is a front view of a golf club head illustrating regions of varying thickness.

FIG. 24 illustrates the variation in the thickness of the striking plate portion 72. The striking plate portion 72 is preferably partitioned into elliptical regions, each having a different thickness. In a preferred embodiment in which the face component 60 is composed of a titanium or titanium alloy material, a central elliptical region 102 preferably has the greatest thickness that ranges from 0.120 inch to 0.090 inch, preferably from 0.115 inch to 0.100 inch, and is most preferably 0.105 inch. The central elliptical region 102 preferably has a uniform thickness. A first concentric region 104 preferably has the next greatest thickness that ranges from 0.110 inch to 0.076 inch, preferably from 0.100 inch to 0.086 inch, and is most preferably 0.088 inch. The first concentric region preferably has a thickness that transitions from the first concentric region 102 thickness to the periphery region 110 thickness. A periphery region 110 preferably has the next greatest thickness that ranges from 0.082 inch to 0.062 inch, and is most preferably 0.072 inch. The variation in the thickness of the striking plate portion 72 allows for the greatest thickness to be localized in the center 111 of the striking plate portion 72 thereby maintaining the flexibility of the striking plate portion 72 which corresponds to less energy loss to a golf ball and a greater coefficient of restitution without reducing the durability of the striking plate portion 72.

Other alternative embodiments of the thickness of the striking plate portion 72 are disclosed in U.S. Pat. No. 6,471,603, for a Contoured Golf Club Face and U.S. Pat. No. 6,398,666 for a Golf Club Striking Plate With Variable Thickness, which are both owned by Callaway Golf Company and which pertinent parts are hereby incorporated by reference.

As mentioned previously, the face component 60 is preferably forged from a rod of metal material. One preferred forging process for manufacturing the face component is set forth in U.S. Pat. No. 6,440,011, entitled Method For Processing A Striking Plate For A Golf Club Head, owned by Callaway Golf Company, and hereby incorporated by reference in its entirety. Alternatively, the face component 60 is cast from molten metal in a method such as the well-known lost-wax casting method. Additional methods for manufacturing the face component 60 include forming the face component 60 from a flat sheet of metal, super-plastic forming the face component 60 from a flat sheet of metal, machining the face component 60 from a solid block of metal, electrochemical milling the face from a forged preform, and like manufacturing methods. Yet further methods include diffusion bonding titanium sheets to yield a variable face thickness face and then superplastic forming.

Alternatively, the face component 60 is composed of an amorphous metal material such as disclosed in U.S. Pat. No. 6,471,604, owned by Callaway Golf Company, and which pertinent parts are hereby incorporated by reference in its entirety.

The golf club head 42 has a high coefficient of restitution thereby enabling for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The coefficient of restitution of the club head 42 under standard USGA test conditions with a given ball ranges from approximately 0.81 to 0.94, preferably ranges from 0.83 to 0.883 and is most preferably 0.87.

Figure 1A:
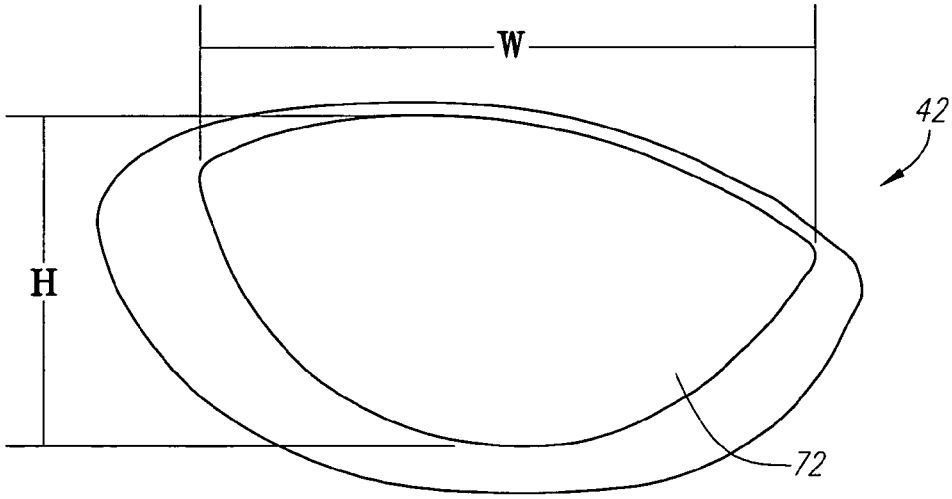
FIG. 1A is a front view of a golf club illustrating the measurement for the aspect ratio of the face.
Figure 2:
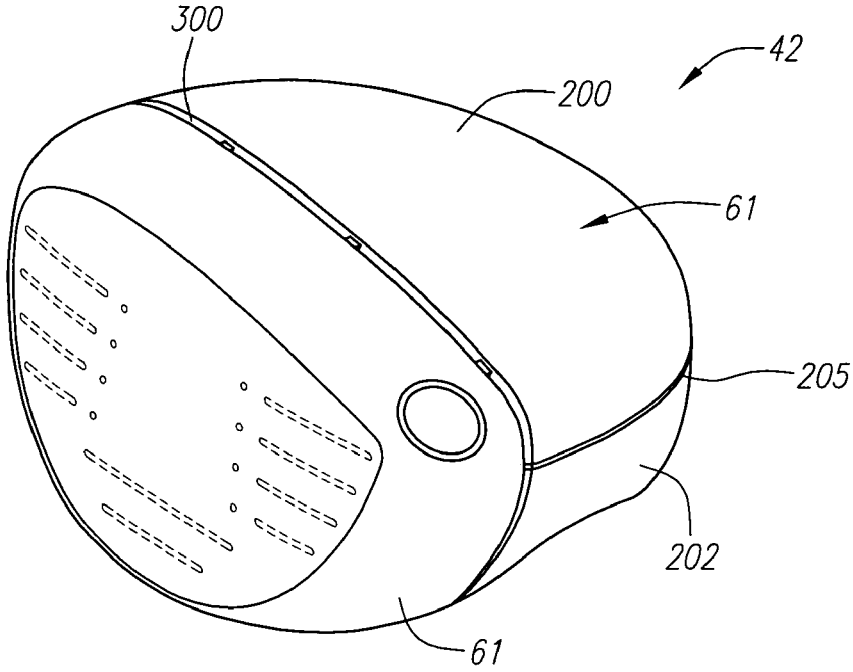
FIG. 2 is a top perspective view of a golf club head.
Figure 3:
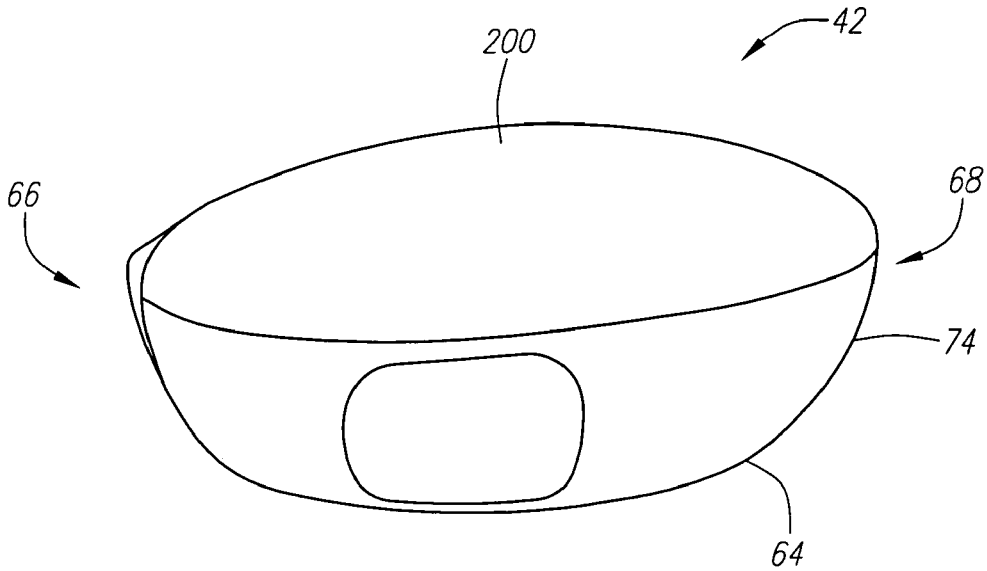
FIG. 3 is rear view of the golf club head of FIG. 2.

Additionally, the striking plate portion 72 of the face component 60 has a smaller aspect ratio than face plates of the prior art. The aspect ratio as used herein is defined as the width, "W", of the face divided by the height, "H", of the face, as shown in FIG. 1A. In one preferred embodiment, the width W is 78 millimeters and the height H is 48 millimeters giving an aspect ratio of 1.625. In conventional golf club heads, the aspect ratio is usually much greater than 1. For example, the original GREAT BIG BERTHA® driver had an aspect ratio of 1.9. The striking plate portion 72 preferably has an aspect ratio that is no greater than 1.7. The aspect ratio preferably ranges from 1.0 to 1.7. One embodiment has an aspect ratio of 1.3. The striking plate portion 72 of the golf club head 42 is more circular than faces of the prior art. The face area of the striking plate portion 72 of the golf club head 42 ranges from 4.00 square inches to 7.50 square inches, more preferably from 5.00 square inches to 6.5 square inches, and most preferably from 5.8 square inches to 6.0 square inches.

The club head 42 preferably has a greater volume than a club head of the prior art while maintaining a weight that is substantially equivalent to that of the prior art. The volume of the club head 42 of the present invention ranges from 290 cubic centimeters to 600 cubic centimeters, and more preferably ranges from 330 cubic centimeters to 510 cubic centimeters, even preferably 350 cubic centimeters to 465 cubic centimeters, and most preferably 385 cubic centimeters or 415 cubic centimeters.

The mass of the club head 42 preferably ranges from 150 grams to 300 grams, more preferably ranges from 175 grams to 250 grams, and yet more preferably ranges from 180 grams to 225 grams. Preferably, the face component 60 has a mass ranging from 50 grams to 110 grams, more preferably ranging from 65 grams to 95 grams, yet more preferably from 70 grams to 90 grams, and most preferably 78 grams. The aft-body 61 (without weighting) has a mass preferably ranging from 10 grams to 60 grams, more preferably from 15 grams to 50 grams, and most preferably 35 grams to 40 grams. The weighting members 122*a*, 122*b* and 122*c* have a combined mass preferably ranging from 30 grams to 120 grams, more preferably from 50 grams to 80 grams, and most preferably 60 grams. The interior hosel 54 preferably a mass preferably ranging from 3 grams to 20 grams, more preferably from 5 grams to 15 grams, and most preferably 12 grams. The plating layer 300 preferably has a mass ranging from 0.5 grams to 5 grams, more preferably from 1.0 grams to 3.0 grams, and most preferably 2.5 grams. Additionally, epoxy, or other like flowable materials, in an amount ranging from 0.5 grams to 5 grams, may be injected into the hollow interior 46 of the golf club head 42 for selective weighting thereof.

Figure 4:
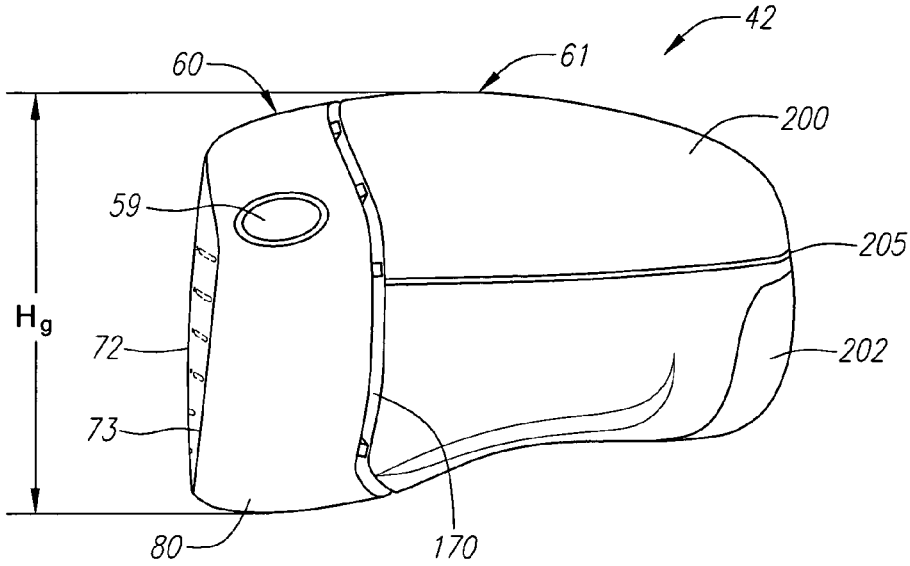
FIG. 4 is a heel side plan view of the golf club head of FIG. 2.
Figure 5:
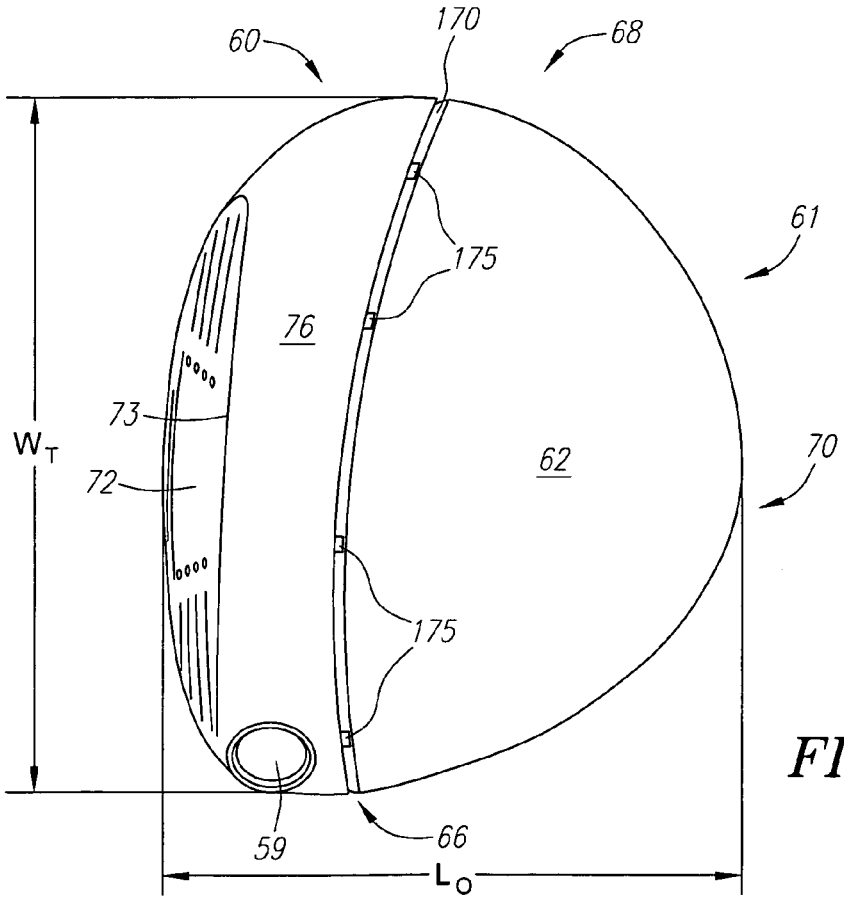
FIG. 5 is a top plan view of the golf club head of FIG. 2.
Figure 6:
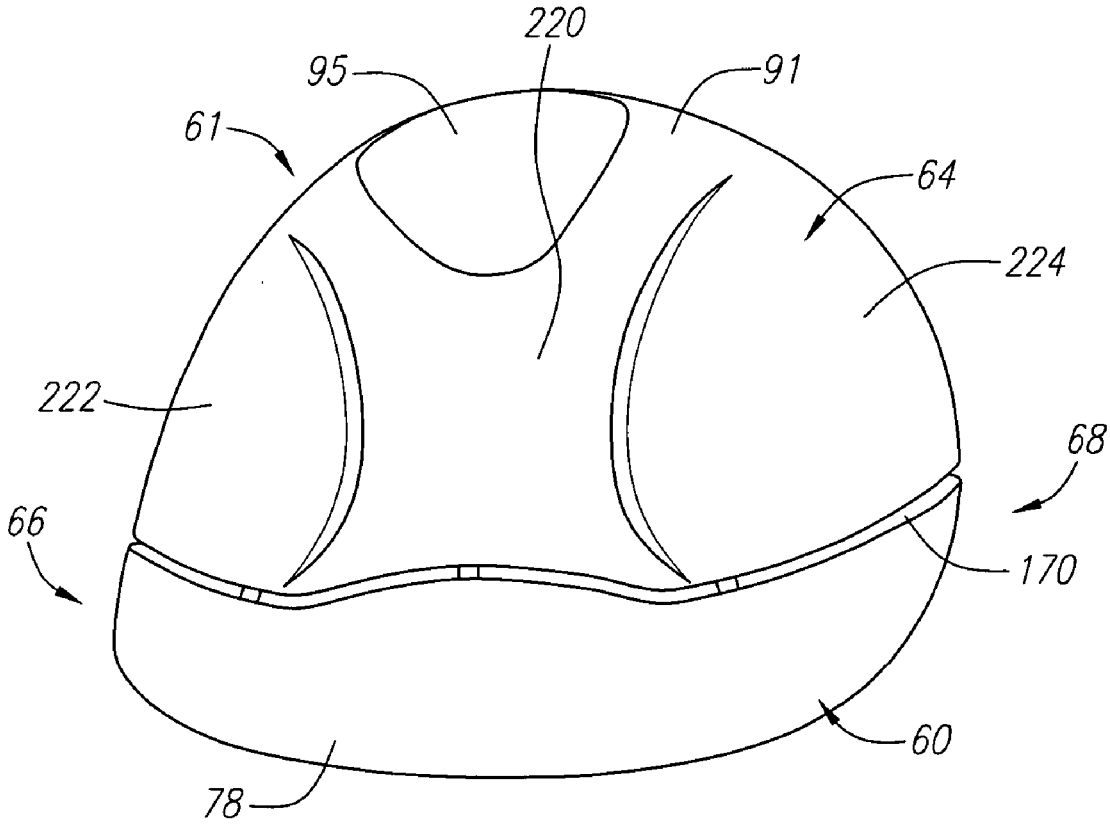
FIG. 6 is a bottom view of the golf club head of FIG. 2.
Figure 7:
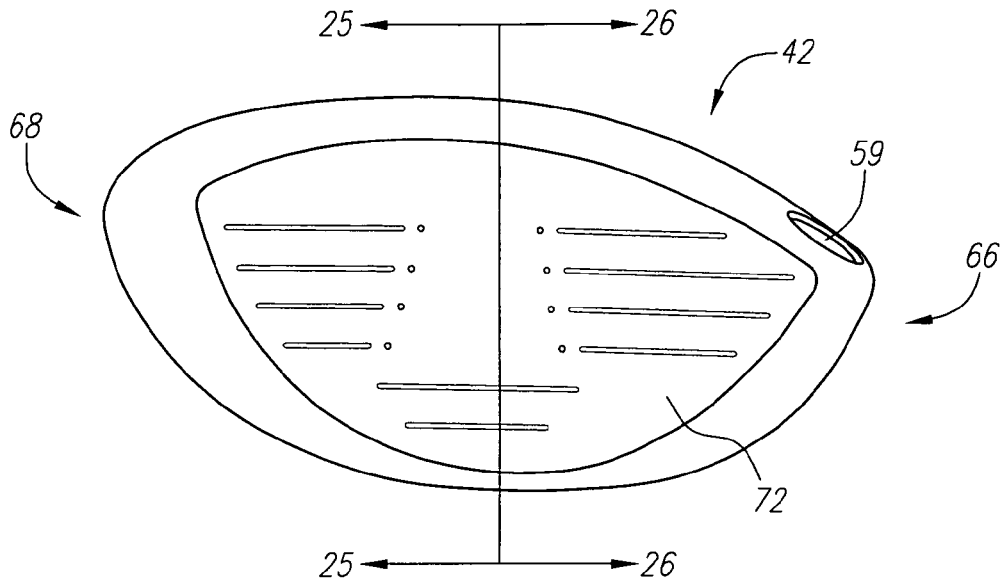
FIG. 7 is a front view of the golf club head.
Figure 8:
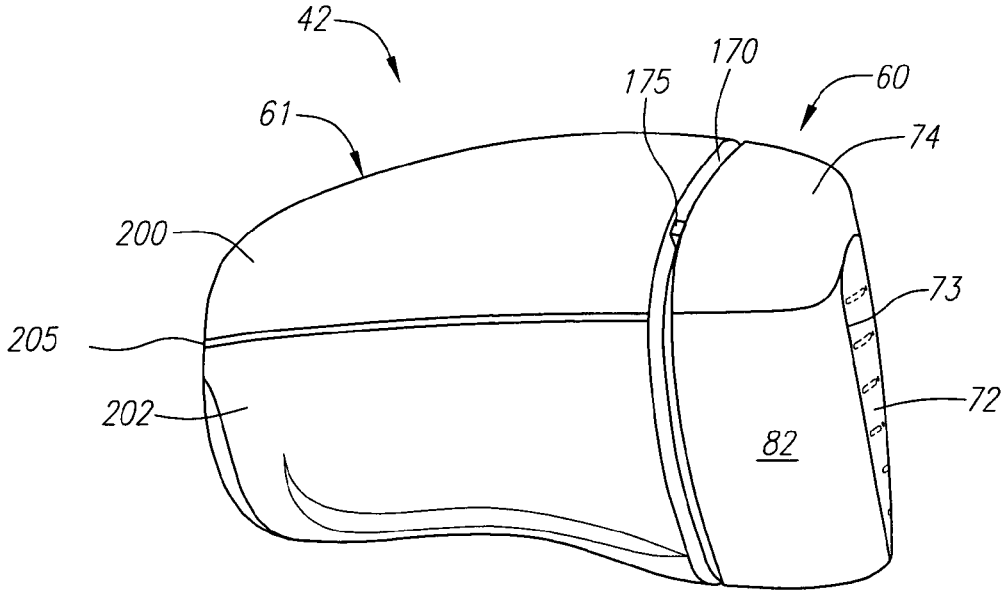
FIG. 8 is a toe side view of the golf club head of FIG. 2.

As shown in FIG. 5, the length, "Lg", of the club head 42 from the striking plate portion 72 to the rear section of the crown portion 62 preferably ranges from 3.0 inches to 4.5 inches, and is most preferably 3.5 inches. As shown in FIG. 4, the height, "Hg", of the club head 42, as measured while in striking position, preferably ranges from 2.0 inches to 3.5 inches, and is most preferably 2.50 inches. As shown in FIG. 5, the width, "Wg", of the club head 42 from the toe section 68 to the heel section 66 preferably ranges from 4.0 inches to 5.0 inches, and more preferably 4.4 inches.

Figure 9:
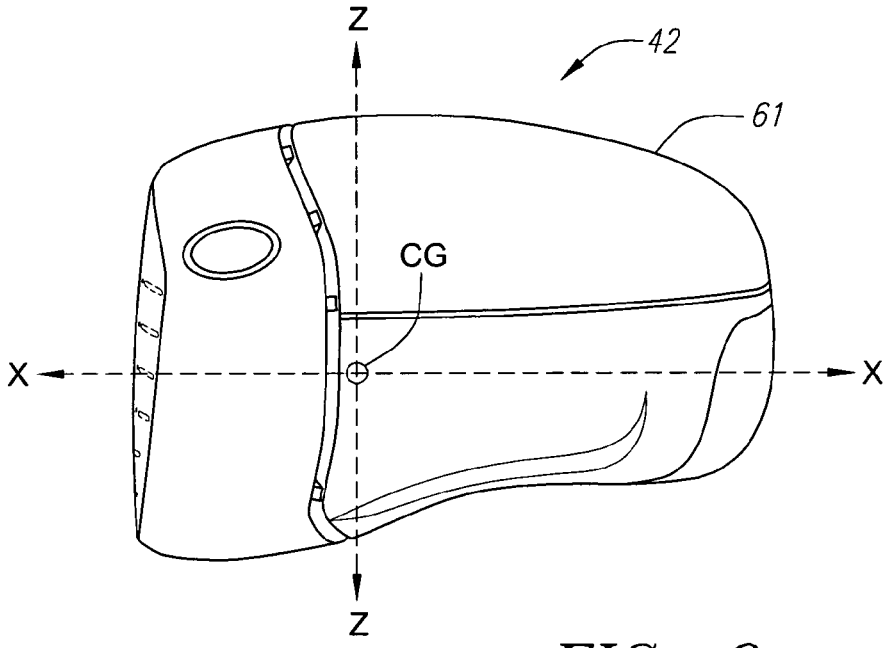
FIG. 9 is a heel side plan view of a golf club head illustrating the Z-axis and X-axis through the center of gravity.
Figure 10:
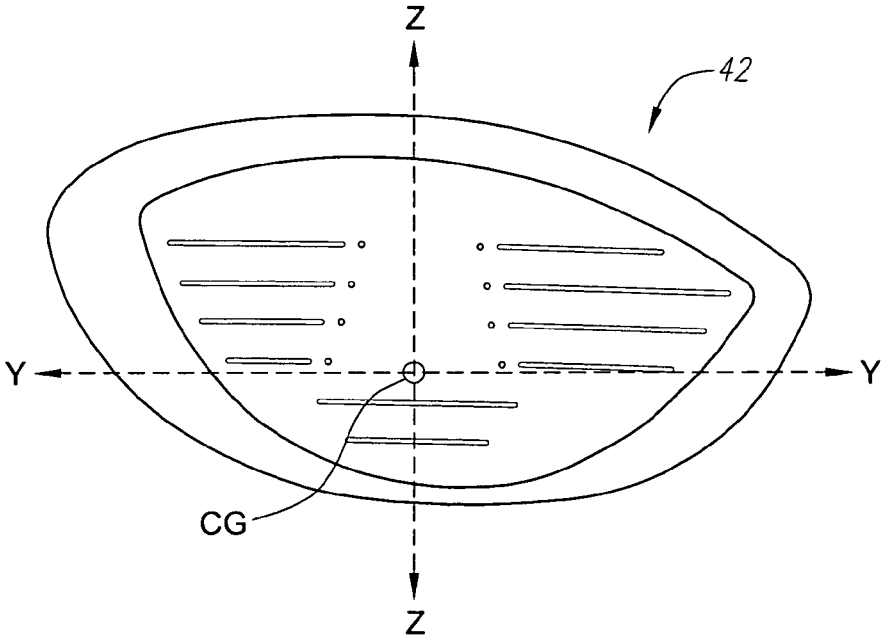
FIG. 10 is a front plan view of a golf club head illustrating the Z-axis and Y-axis through the center of gravity.

FIGS. 9 and 10 illustrate the axes of inertia through the center of gravity of the golf club head. The axes of inertia are designated X, Y and Z. The X-axis extends from the striking plate portion 72 through the center of gravity, CG, and to the rear of the golf club head 42. The Y-axis extends from the toe section 68 of the golf club head 42 through the center of gravity, CG, and to the heel section 66 of the golf club head 42. The Z-axis extends from the crown portion 62 through the center of gravity, CG, and to the sole portion 64.

As defined in *Golf Club Design, Fitting, Alteration & Repair,* 4$^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity of a golf club head may be obtained using a center of gravity table having two weight scales thereon, as disclosed in U.S. Pat. No. 6,607,452, entitled High Moment Of Inertia Composite Golf Club, assigned to Callaway Golf Company, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 42 of the present invention will range from 2800 g-cm$^2$ to 5000 g-cm$^2$, preferably from 3000 g-cm$^2$ to 4500 g-cm$^2$, and most preferably from 3750 g-cm$^2$ to 4250 g-cm$^2$. The moment of inertia, Iyy, about the Y axis for the golf club head 42 preferably ranges from 1500 g-cm$^2$ to 2750 g-cm$^2$, preferably from 2000 g-cm$^2$ to 2400 g-cm$^2$, and most preferably from 2100 g-cm$^2$ to 2300 g-cm$^2$. The moment of inertia, Ixx, about the X axis for the golf club head 42 preferably ranges from 1500 g-cm$^2$ to 4000 g-cm$^2$, preferably from 2000 g-cm$^2$ to 3500 g-cm$^2$, and most preferably from 2500 g-cm$^2$ to 3000 g-cm$^2$.

In general, the golf club head 42 has products of inertia such as disclosed in U.S. Pat. No. 6,425,832, and is hereby incorporated by reference in its entirety. Preferably, each of the products of inertia, Ixy, Ixz and Iyz, of the golf club head 42 have an absolute value less than 100 g-cm$^2$. Alternatively, the golf club head 42 has a at least one or two products of inertia, Ixy, Ixz and Iyz, with an absolute value less than 100 g-cm$^2$.

Figure 29:
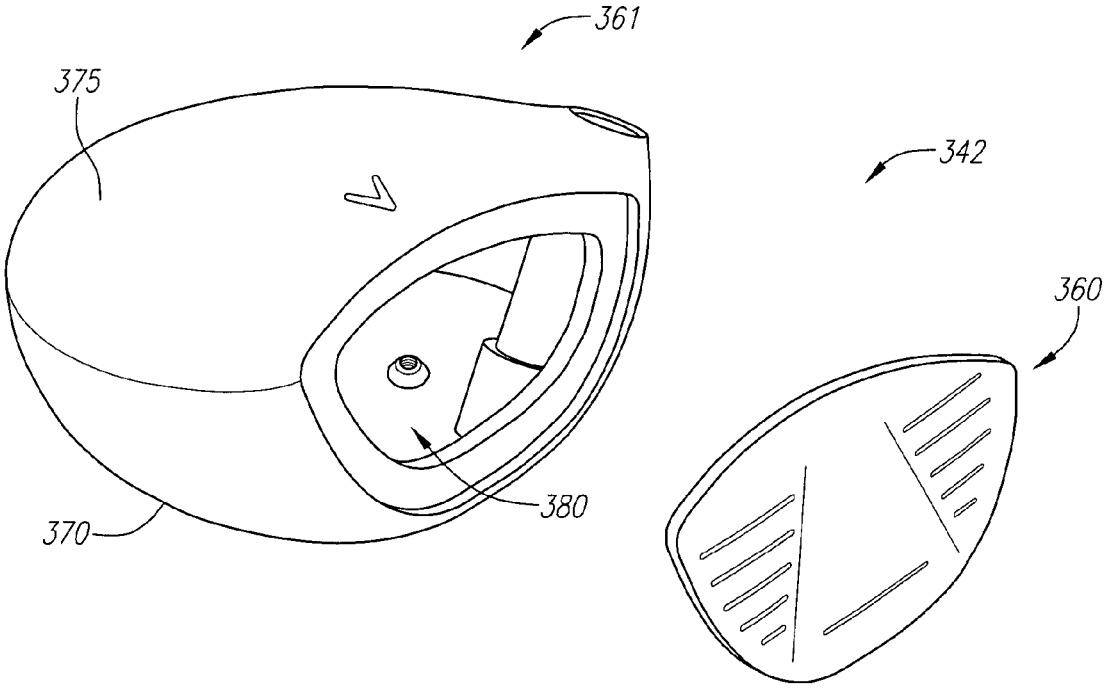
FIG. 29 is a top exploded perspective view of a golf club head.

FIG. 29 illustrates an alternative embodiment of a golf club head 342 having a plated magnesium portion. The golf club head 342 has a striking plate 360 and an aft-body 361. The aft-body 361 comprises a sole section 370 and a crown section 375. The striking plate 360 is preferably composed of a titanium alloy, titanium, amorphous metal (as described above) stainless steel or other steel alloy. The aft-body 361 is preferably composed of a low density-metal material, preferably a magnesium alloy, aluminum alloy, magnesium or aluminum material, such as described above, which also has a plating layer 300 (as described above) on a portion of the aft-body 361. The striking plate 360 is positioned over an opening 380 in the aft-body 361, and attached to the aft-body 361 through well-known methods such as press-fitting, brazing and the like. In one embodiment, the sole section 370 has a plating layer 300. In another embodiment, the sole section 370 and the crown section 375 both have plating layers 300. The golf club head 342 preferably has similar volumes, CORs, moments of inertia, mass and products of inertia as described above in reference to the golf club head 42.

Figure 30:
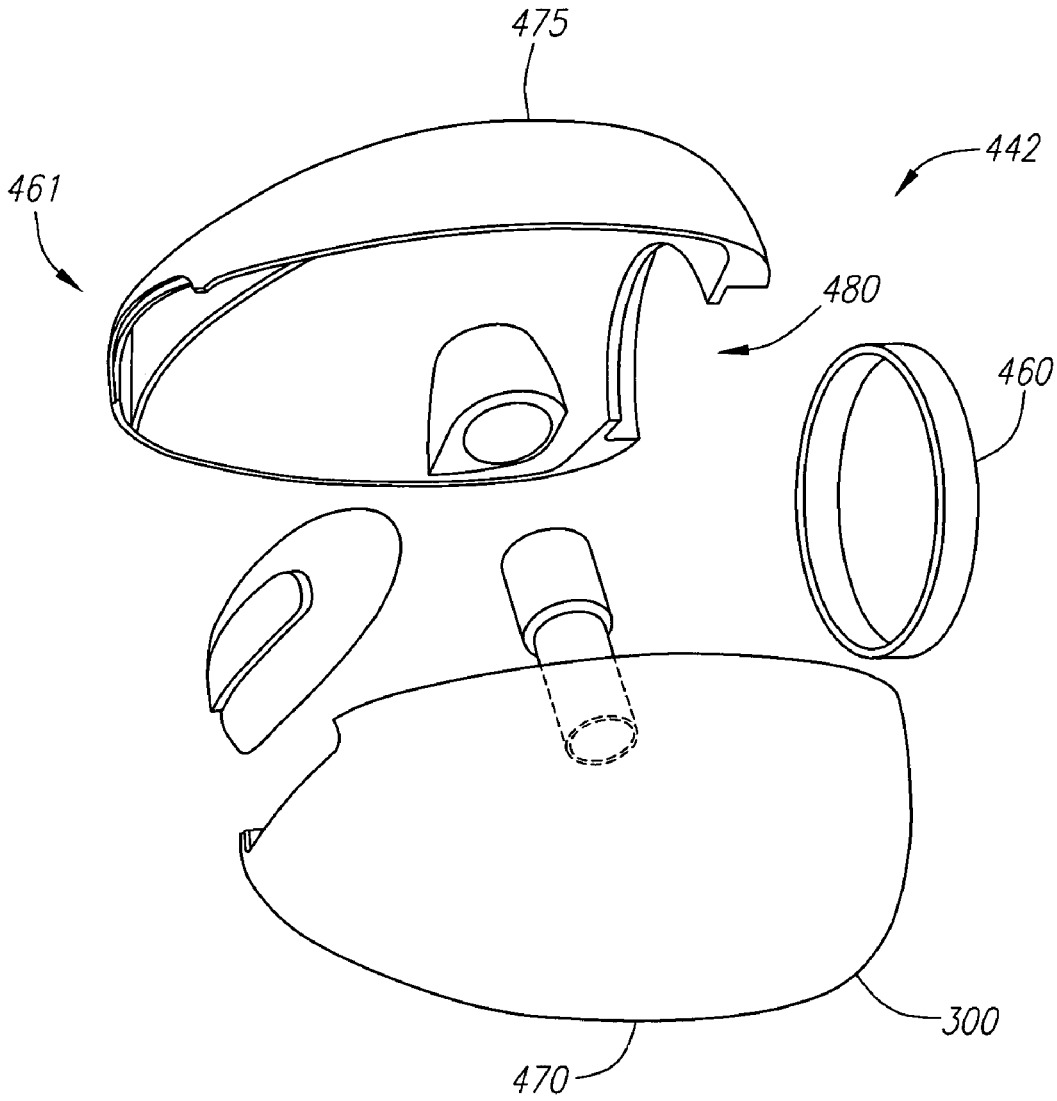
FIG. 30 is a bottom exploded perspective view of a golf club head.

FIG. 30 illustrates an alternative embodiment of a golf club head 442 having a plated magnesium portion. The golf club head 442 has a striking plate 460 and an aft-body 461 with a sole section 470 and a crown section 475. The striking plate 460 is preferably composed of a titanium alloy, titanium, amorphous metal (as described above) stainless steel or other steel alloy. The aft-body 461 is preferably composed of a low density-metal material, preferably a magnesium alloy, aluminum alloy, magnesium or aluminum material, such as described above, which also has a plating layer 300 (as described above) on a portion of the aft-body 461. The striking plate 460 is positioned over an opening 480 in the aft-body 461, and attached to the aft-body 461 through well-known methods such as press-fitting, brazing and the like. In one embodiment, the sole section 470 has a plating layer 300. In another embedment, both the sole section 470 and the crown section 475 have a plating layer 300. The golf club head 442 preferably has similar volumes, CORs, moments of inertia, mass and products of inertia as described above in reference to the golf club head 42.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a body composed of a magnesium alloy material, the body comprising at least a portion of a sole and a portion of a crown of the golf club head; and a plating deposited on the portion of the sole of the body, the plating comprising a layer composed of a nickel or a nickel-based alloy material, and at least one additional layer composed of a material selected from the group consisting of zinc, chromium, tin-cobalt and copper, wherein the plating has a mass ranging from 1.0 gram to 3.0 grams and a thickness ranging from 0.0002 inch to 0.002 inch;

wherein the golf club head has a mass ranging from 180 grams to 225 grams, a volume ranging from 350 cubic centimeters to 465 cubic centimeters, and a moment of inertia about the Izz axis of the golf club head is greater than 3000 g-cm$^2$.

2. The golf club head according to claim 1 wherein the nickel or nickel-based alloy material comprises a layer of MAGENTA electroless nickel and a layer of medium or high phosphorus electroless nickel.

3. The golf club head according to claim 1 wherein the plating comprises a zinc layer on the magnesium alloy material of the body, a copper layer on the zinc layer, the nickel or nickel-based alloy on the copper layer, and a tin-cobalt or chromium layer on the nickel or nickel-based alloy layer.

4. The golf club head according to claim 1 wherein the plating has a Rockwell C hardness greater than 50.

5. The golf club head according to claim 1 further comprising a plating material on the crown portion of the body.

6. A golf club head comprising:

a face component composed of a metal material, the face component having a striking plate portion and a return portion, the striking plate portion having a thickness in the range of 0.010 inch to 0.250 inch and the return portion having a thickness ranging from 0.010 inch to 0.250 inch, wherein the face component has a mass ranging from 65 grams to 95 grams;

an aft-body composed of a metal material selected from the group consisting of magnesium, magnesium alloys, aluminum, and aluminum alloys, the aft-body having a crown portion, a sole portion and a ribbon portion, the aft-body attached to the return portion of the face component wherein the aft-body has a mass ranging from 10 grams to 60 grams;

a plurality of weight members having a combined mass ranging from 30 grams to 120 grams, each of the plurality of weight members disposed with a weight cavity of the aft-body; and a plating disposed on the aft-body, the plating comprising a layer composed of a nickel or a nickel-based alloy material, and at least one additional layer composed of a material selected from the group consisting of zinc, chromium, tin-cobalt and copper, wherein the plating has a mass ranging from 1.0 gram to 3.0 grams and a thickness ranging from 0.0002 inch to 0.002 inch;

wherein the golf club head has a mass ranging from 180 grams to 225 grams, a volume ranging from 350 cubic centimeters to 465 cubic centimeters, and a moment of inertia about the Izz axis of the golf club head is greater than 3000 g-cm$^2$.

7. The golf club head according to claim 6 wherein the plating comprises a layer of MAGENTA electroless nickel and a layer of medium or high phosphorus electroless nickel.

8. The golf club head according to claim 6 wherein the plating comprises a zinc layer on the metal aft-body, a copper layer on the zinc layer, the nickel or nickel-based alloy on the copper layer, and a tin-cobalt or chromium layer on the nickel or nickel-based alloy layer.

9. The golf club head according to claim 6 wherein the aft-body is composed of an injection molded metal material.

10. The golf club head according to claim 6 wherein the face component is composed of a metal material selected from the group consisting of titanium alloy, amorphous metal, stainless steel and maraging steel.

11. The golf club head according to claim 6 wherein the nickel or nickel-based alloy is deposited by an electrolytic process.

12. The golf club head according to claim 6 wherein the nickel or nickel-based alloy is deposited by an electroless process.

13. A golf club head comprising:

a face component composed of a metal material, the face component having a striking plate portion and a return portion, the striking plate portion having a thickness in the range of 0.010 inch to 0.250 inch and the return portion having a thickness ranging from 0.010 inch to 0.250 inch, the return portion extending a distance ranging 0.25 inch to 1.5 inches, wherein the face component has a mass ranging from 65 grams to 95 grams;

an aft-body comprising an upper section and a lower section, the upper section comprising a crown portion and an upper ribbon portion and the lower section comprising a sole portion and a lower ribbon portion, the aft-body composed of a metal material selected from the group consisting of magnesium, magnesium alloys, aluminum, and aluminum alloys, the aft-body attached to the return portion of the face component, the aft-body having a thickness ranging from 0.015 inch to 0.100 inch, wherein the aft-body has a mass ranging from 10 grams to 60 grams;

a plurality of weight members having a combined mass ranging from 30 grams to 120 grams, each of the plurality of weight members disposed with a weight cavity of the aft-body; and a plating disposed on the aft-body, the plating comprising nickel or a nickel-based alloy material, and at least one additional layer composed of a material selected from the group consisting of zinc, chromium, tin-cobalt and copper, the plating having a thickness ranging from 0.0002 inch to 0.002 inch and a mass ranging from 1.0 gram to 3.0 grams;

wherein the golf club head has a mass ranging from 180 grams to 225 grams, a volume ranging from 350 cubic centimeters to 465 cubic centimeters, and a moment of inertia about the Izz axis of the golf club head is greater than 3000 g-cm$^2$.

* * * * *